United States Patent [19]

Durham, Jr.

[11] Patent Number: 4,974,364

[45] Date of Patent: Dec. 4, 1990

[54] WINDOW CONSTRUCTION

[75] Inventor: Robert C. Durham, Jr., Fort Lauderdale, Fla.

[73] Assignee: Chelsea Industries, Inc., Boston, Mass.

[21] Appl. No.: 422,748

[22] Filed: Oct. 16, 1989

[51] Int. Cl.[5] ..... E05D 7/00; E06B 3/00

[52] U.S. Cl. ..... 49/400; 49/501; 49/504; 49/DIG. 2; 52/475; 52/656; 52/774; 52/775

[58] Field of Search ..... 49/400, 401, 402, 504, 49/501, DIG. 2; 52/788, 475, 477, 731, 207, 656, 773, 774, 775, 776

[56] References Cited

U.S. PATENT DOCUMENTS

| | | | |
|---|---|---|---|
| 1,040,572 | 10/1912 | Otterson | 52/773 |
| 2,714,432 | 8/1955 | Blanchard | 52/774 |
| 3,520,084 | 7/1970 | Gigante | 49/504 X |
| 3,859,754 | 1/1975 | Budich et al. | 40/425 |
| 4,328,644 | 5/1982 | Scott et al. | 49/501 |
| 4,555,800 | 6/1984 | Hosooka et al. | 52/309 |
| 4,640,078 | 2/1987 | Haffer | 49/DIG. 2 X |
| 4,676,026 | 6/1987 | Schreiner | 49/401 X |
| 4,740,405 | 4/1988 | Tanaka et al. | 428/45 |
| 4,831,781 | 5/1989 | Morton | 49/504 |

FOREIGN PATENT DOCUMENTS

| | | | |
|---|---|---|---|
| 2191529 | 12/1987 | United Kingdom | 49/504 |

*Primary Examiner*—Philip C. Kannan
*Attorney, Agent, or Firm*—Oltman and Flynn

[57] ABSTRACT

This peripheral member is for use in a frame holding one or more window panes and in a framework for attachment along the inside of a window opening in a building structure. It has a hollow rectangular main body and a narrower rectangular extension. The main body and the extension form a right-angled inside corner where their adjoining sides present intersecting longitudinal recesses. These sides of the main body and the extension have longitudinal grooves located away from the inside corner. The remaining faces of the main body and the extension are flat, including a face on the extension that is a co-planar continuation of a corresponding face on the main body.

19 Claims, 4 Drawing Sheets

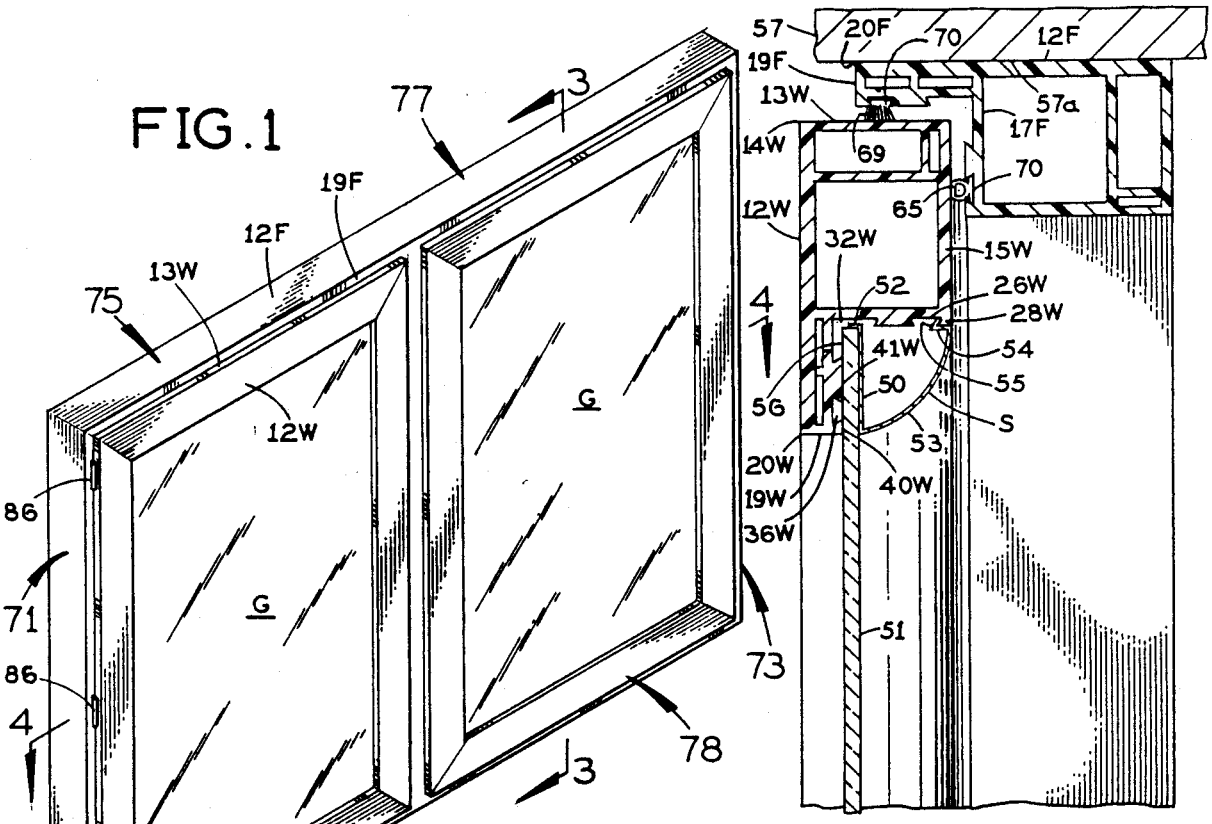
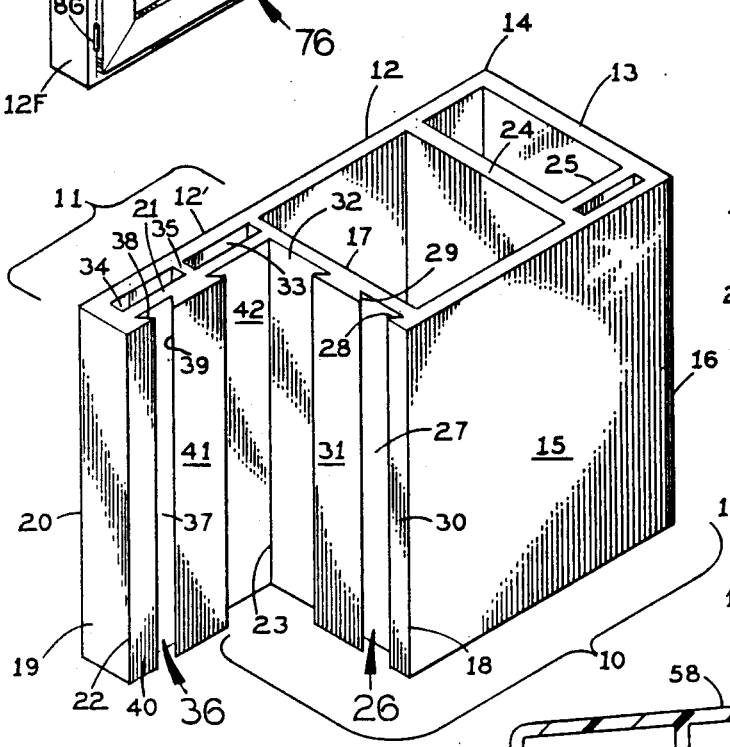
FIG.2
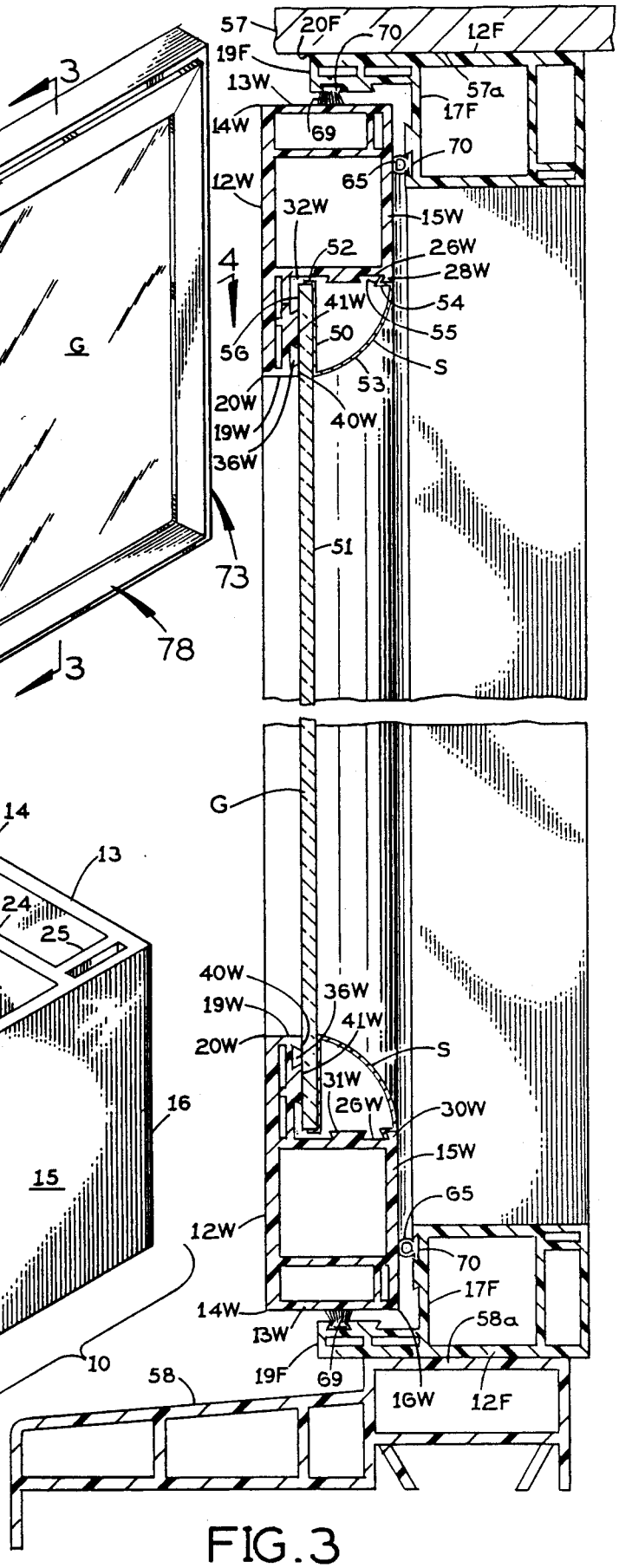
FIG.3

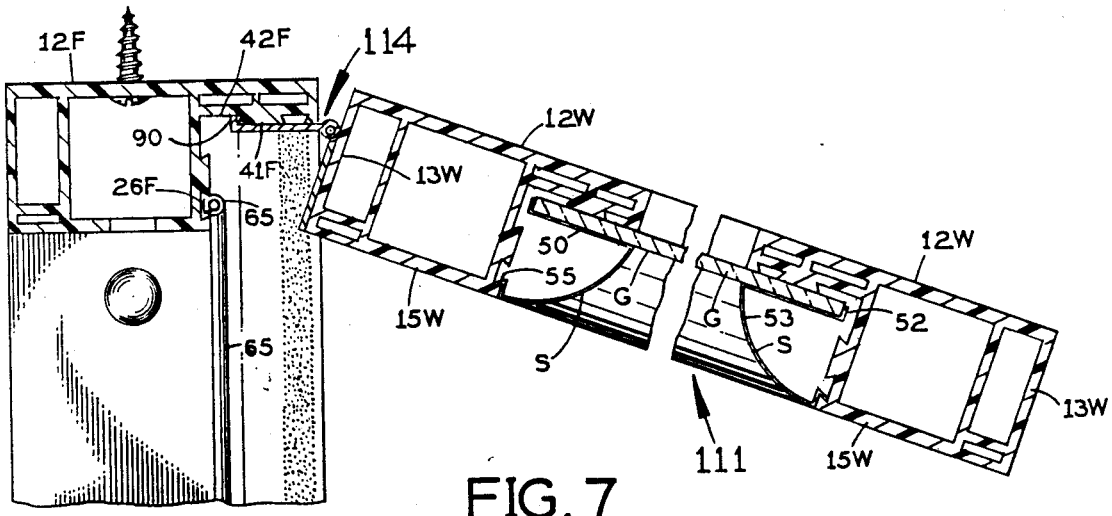
FIG. 7
FIG. 10
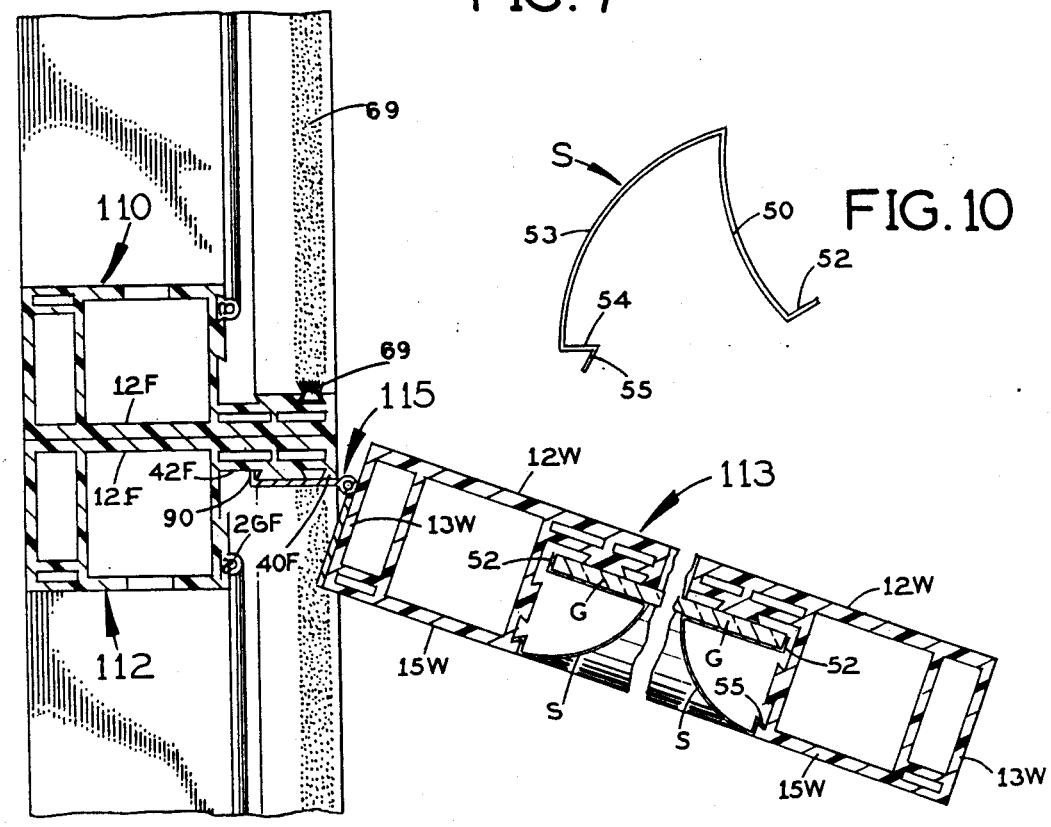
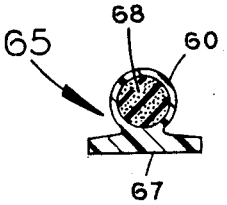
FIG. 11
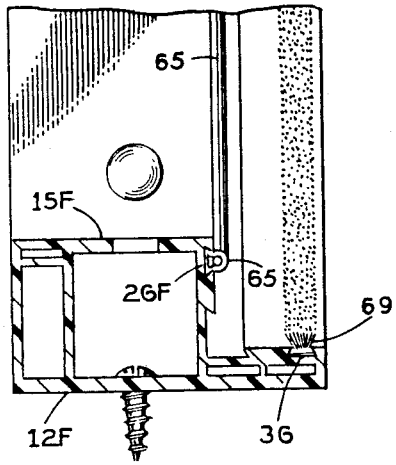

WINDOW CONSTRUCTION

SUMMARY OF THE INVENTION

This invention relates to a peripheral member for use in a window assembly, preferably along the edges of the window itself and also as a framework for the window.

One objective of this invention is to simplify and reduce the cost of making various window installations by providing a peripheral member that can be used equally well (1) on the window itself to provide a substantially rigid peripheral frame holding the window pane or panes and (2) as a framework attached permanently to the building structure along the edges of a window opening therein and engageable by the frame on the window when the window is closed. Preferably, the peripheral members for both uses are cut to size from a long extruded plastic body having a novel external configuration which enables it to be used in a variety of window constructions, including side-hinged windows, top-hinged windows, double-paned windows, and windows that are permanently closed.

Another object of this invention is to provide a novel window having a frame which holds one or more window panes made up of several interconnected peripheral members of identical cross-section.

Another object of this invention is to provide a novel framework for permanent attachment to a building structure along the edges of an opening for a window, which framework is made up of several interconnected peripheral members of identical cross-section.

Another object of this invention is to provide a novel window asembly having peripheral members of the same cross-section as the frame on the window itself and as the framework which borders the window opening in the building structure.

Another object of this invention is to provide a novel peripheral member of readily extrudable cross-section and adequate strength for use as either or both a peripheral member on a window and part of a framework on the inside of a window opening in a building wall.

Another object of this invention is to provide a novel peripheral member which can be readily joined adhesively to other peripheral members of the same or different cross-section to provide either or both a frame holding a window pane or panes and a framework on the inside of an opening for a window in a wall of a building.

Another object of this invention is to minimize the inventory of parts required for a window assembly by providing an extruded peripheral member which can be used to provide both a building - mounted framework for a window and a frame holding the window pane or panes in place.

Further objects and advantages of this invention will be apparent from the following detailed description of a presently preferred embodiment which is illustrated schematically in the accompanying drawings.

DESCRIPTION OF THE DRAWINGS

FIG. 1 is a perspective view of a side-hinged double window and the framework mounting it in a wall of a building in accordance with a first embodiment of the present invention;

FIG. 2 is a fragmentary perspective view showing part of the peripheral member for either the window or the framework in FIG. 1;

FIG. 3 is a vertical cross-section taken along the line 3—3 in FIG. 1;

FIG. 7 is a vertical cross-section taken along the line 7—7 in FIG. 6;

FIG. 10 is an end view of the glazing strip strip used with the peripheral members on the window, showing this strip in its unstressed condition; and FIG. 11 is an end view of one of the sealing gaskets acting between each peripheral member in the framework and the adjacent peripheral member on the window.

DETAILED DESCRIPTION

Figures 4, 5:
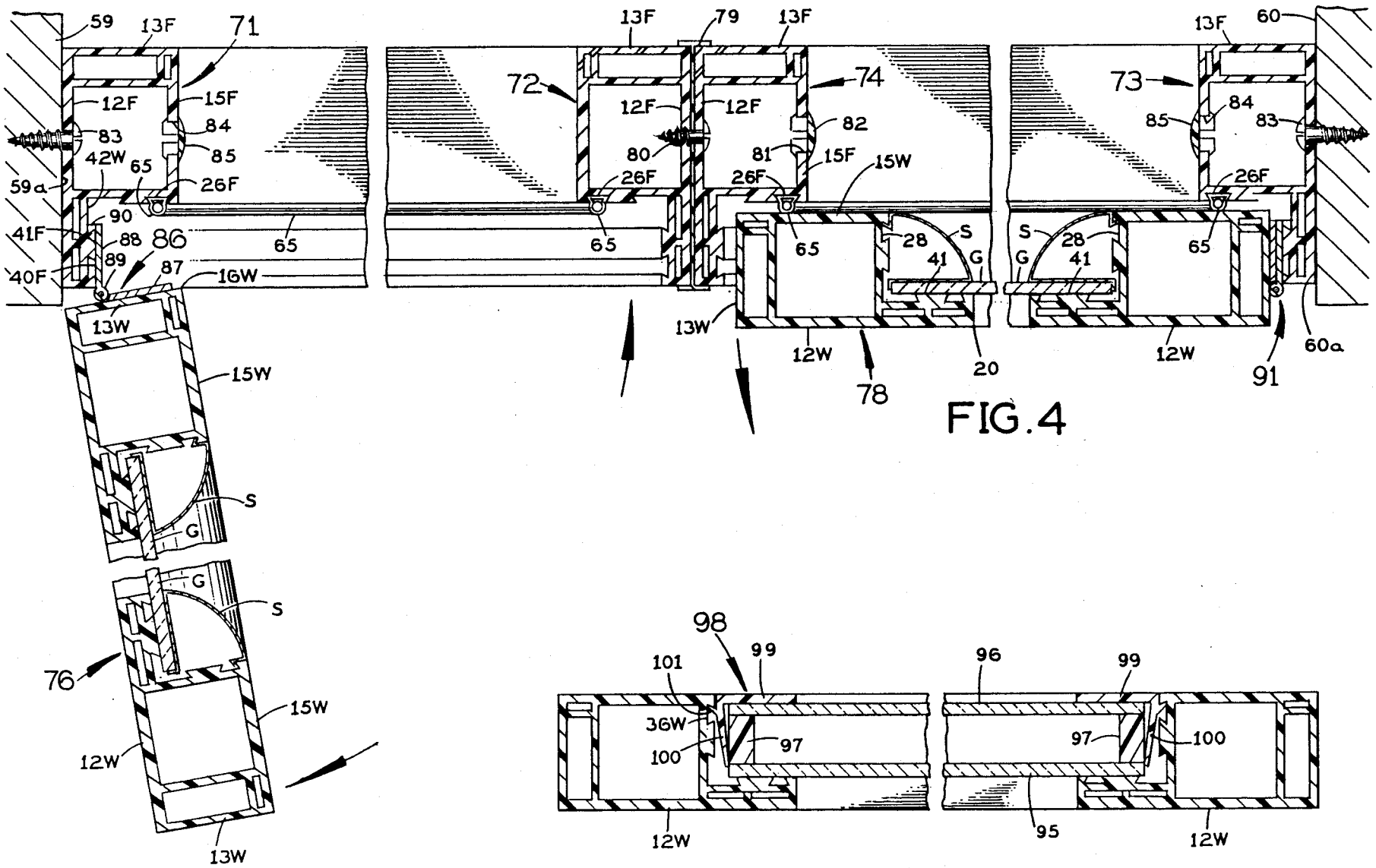
FIG. 4 is a horizontal cross-section taken along the line 4—4 in FIG. 1.
FIG. 5 is a view like FIG. 3 showing a window with two panes of glass and having the same peripheral members on the window and the framework as in FIG. 1–4.

FIG. 2 shows the cross-section of a peripheral member in accordance with the present invention. This peripheral member has a main body 10 of generally rectangular cross-section and an extension 11 of thinner cross-section joined integrally to one end of the main body. Preferably, the peripheral member is a one-piece extrusion of polyvinyl chloride or other suitable plastic.

The main body 10 of the peripheral member has a first side 12 presenting an exposed flat face on the outside, an outer end 13 presenting an exposed flat outer end face intersecting the exposed face of the first side 12 at a right-angled first outside corner 14 and extending perpendicular to it, a second side 15 presenting an exposed flat face on the outside which intersects the outer end face 13 at a right-angled second outside corner 16 on the main body 10 and extends parallel to the exposed face of the first side 12, and inner end 17 extending parallel to the outer end 13 between the first and second sides 12 and 15 and forming a right-angled third outside corner 18 with the exposed face of the second side 15.

The extension 11 on the peripheral member is joined integrally to its main body 10 at the inner end 17 of the main body. The extension projects from the main body in the direction away from its outer end 13. Extension 11 has a first side 12' which presents an exposed flat face on the outdside that is a coplanar continuation of the exposed face of the first side 12 of the main body 10. Extension 11 has an outer end 19 which presents an exposed end face that perpendicularly intersects the exposed face of its first side 12' at a right-angled fourth outside corner 20 on the peripheral member. Extension 11 has a second side 21 extending generally parallel to its first side 12' between its outer end 19 and the inner end 17 of the main body 10 of the peripheral member. The second side 21 of the extension forms a right-angled fifth outside corner 22 with its outer end 19 and a right-angled inside corner 23 with the inner end 17 of the main body.

The main body 10 of the peripheral member is hollow between its first and second sides 12 and 15 and its ends 13 and 17 except for a first reinforcing wall 24, which extends between its sides 12 and 15 parallel to its end 13, and a second reinforcing wall 25, which extends between the first reinforcing wall 24 and the end 13 parallel to the second side 15.

The main body 10 has a longitudinal first groove 26 in its inner end 17 near the third outside corner 18. This groove has a flat bottom surface 27 and opposite side edges 28 and 29 which incline toward each other away from the bottom surface 27, so that the groove has its narrowest width at the exposed flat faces 30 and 31 of inner end 17, which are located on opposite sides of groove 26. Between the inside corner 23 and its exposed face 31, the inner end presents a longitudinal recess 32 of the same depth as groove 26.

The extension 11 on the peripheral member is formed with rectangular cavities 33 and 34 between its first and second sides 12' and 21. These cavities are separated by a reinforcing segment 35 which extends perpendicularly between sides 12' and 21. The extension has a longitudinal second groove 36 in its second side 21 near the fifth outside corner 22 on the peripheral member. This groove has a flat bottom surface 37 and opposite side edges 38 and 39 which incline toward each other away from the bottom surface 37 so that the groove has its narrowest width at the exposed flat faces 10 and 41 of the second side 21 of the extension. Between the inside corner 23 and its exposed face 41 the second side 21 of the extension presents a longitudinal recess 42 of the same depth as its groove 36. The respective recesses 32 and 42 in the inner end 17 of the main body 10 and in the second side 21 of the extension 11 intersect at the inside corner 23 of the peripheral member.

In each of the four different window assemblies shown respectively in FIGS. 1, 3 and 4, FIG. 5, FIGS. 6–8, and FIG. 9, the elements of each peripheral member which is on the window have the same reference numerals, with a "W" suffix added, as those in FIG. 2. Likewise, in each window assembly the elements of each peripheral member which is in the framework have the same reference numerals, with an "F" suffix added, as those in FIG. 2.

As shown in FIGS. 3 and 4, each of the two windows in FIG. 1 has a flat rectangular pane of glass G which is bordered along the top and bottom (FIG. 3) and along its opposite side edges (FIG. 4) by a respective peripheral member with a cross-section as shown in FIG. 2. The four peripheral members fit together and are joined to each other at the corners of the window pane. Along each edge the window pane is held in the adjacent peripheral member by an extruded, flexible and resilient, plastic glazing strip S having a flattened front leg 50 engaging the back face 51 of the window pane G, a narrow transverse flange 52 at one end of leg 50 extending across the edge of the window pane, an arcuate leg 53 extending rearward from the opposite end of leg 50, a narrow flange 54 joined to the opposite end of the arcuate leg 53 from its attachment to leg 50 and extending from arcuate leg 53 toward leg 50, and a transverse lip 55 joined to the edge of flange 54 away from its connection to the curved leg 53. The lip 55 on the glazing strip projects into the first groove 26W in the peripheral member on the window and engages the side face 28W of this groove, while the flange 54 on the glazing strip engages the exposed face 30W of the peripheral member between its third outside corner 18W and groove 26W.

The glazing strip S is stressed and resiliently deformed by its engagement with the window pane G and the peripheral member, as shown. FIG. 10 shows the glazing strip S in its normal, unstressed condition before it is inserted between the window pane and a peripheral member on the window. Normally, leg 50 has an arcuate curvature away from the arcuate leg 53 and it is deformed to the flat condition, abutting against the back face 51 of the window pane, when the glazing strip S is assembled to the window pane and the peripheral member on the window. This deformation stresses the glazing strip so that it resiliently holds the front face 56 of the window pane against the exposed faces 40W and 41W of the extension 11 on the adjacent peripheral member on the window.

As shown in FIG. 3, the opening in the building wall for the two windows has a horizontal piece 57 at the top and a horizontal window sill 58 at the bottom. As shown in FIG. 4, this opening has vertical pieces 59 and 60 along its opposite sides extending up from the window sill 58 to the top piece 57. Thus, window sill 58 and pieces 57, 59 and 60 define a rectangular opening in the building for two side-pivoted windows as shown in FIG. 1. A respective elongated peripheral member with a cross-section as shown in FIG. 2 is rigidly attached along the bottom face **57*a* (FIG. 3) of the top frame piece 57, the top face 58*a* of window sill 58, the inside face 59*a* (FIG. 4) of side frame piece 59, and the inside face 60*a* of the opposite side frame piece 60**.

As shown in FIGS. 3 and 4, the first side 12F of each peripheral member in the framework engages the respective inside face **57*a*,58*a*,59*a* or 60*a* of the adjacent piece of the building wall. The inner end 17W of each peripheral member of the framework extends behind the second side 15W of the corresponding peripheral member on the window and is spaced slightly from it. A sealing gasket 65 is engaged under compression between each peripheral member in the framework and the corresponding peripheral member on the window. As shown in FIG. 11, this sealing gasket has a tubular segment 66 joined to a flat base 67, which projects on opposite sides of the tubular segment. Elements 66 and 67 are parts of an extruded, one-piece, plastic body of polyvinyl chloride or other suitable material. A compressible and resilient material 68 fills the tubular segment 66 of the gasket. The flat base 67 of the gasket is snugly held in the first groove 26F in the peripheral member for the window frame and the tubular segment 66 of the gasket is pressed against the second side 15W** of the adjacent peripheral member on the window when the window is closed.

The extension 11 of each peripheral member in the framework extends outside the outer end 13W of the adjacent peripheral member on the window. A soft-bristled weatherstrip member 69 acts between these walls of the peripheral members. This seal member has a flat base 70 snugly held in the second groove 36F in the peripheral member for the frame and flexible and resilient bristles projecting out from this base and pressed against the outer end wall 13W of the adjacent peripheral member on the window.

In the embodiment of the invention shown in FIGS. 1–4, each of the two windows is bounded by a rectangular assembly of peripheral members in the window framework. Thus, as shown in FIG. 4, there is a peripheral member 71 in the framework extending along the left edge of the left-hand window and a peripheral member 72 in the framework extending along the right edge of this window, and a peripheral member 73 in the framework extending along the right edge of the right-hand window and a peripheral member 74 in the frame work extending along the left edge of this window. A top peripheral member 75 (FIG. 1) for the left-hand window extends between the side peripheral members 71 and 72 at the top, and a bottom peripheral member 76 extends between them at the bottom. A top peripheral member 77 for the right-hand window extends between the side peripheral members 73 and 74 at the top, and a bottom peripheral member 78 extends between them at the bottom.

A mullion 79 (FIG. 4) of conventional design is clamped between the first sides 12F of peripheral members 72 and 74 by screws 80, which fasten these two peripheral members together at intervals along their length. The second side 15F of peripheral member 74 has an access opening 81 opposite each screw 80 which is closed by a removable plug 82. The first side 12F of the left-hand peripheral member 71 is fastened to the adjacent side piece 59 of the window frame by screws 83. The second side 15F of this peripheral member has an access opening 84 opposite each screw 83 which is closed by a removable plug 85. The right-hand peripheral member 73 has an identical arrangement for access to the screws which fasten it to frame piece 60.

As shown in FIG. 1, the left-hand window has hinges 86 along its left-hand edge. As shown in FIG. 4, each hinge 86 has a flat leaf 87 adhesively secured to the outer end 13W of the adjacent peripheral member on the window and a flat leaf 88 adhesively secured to the exposed faces 40F and 41F of the extension on the corresponding peripheral member in the framework. The hinge leaves 87 and 88 are pivotally coupled to each other by a hinge pin 89 located next to the fifth outside corner 22F of the peripheral member in the framework. Hinge leaf 88 has a transverse flange 90 along its edge away from hinge pin 89 which extends into recess 42F in the periphral member of the framework.

The right-hand window has hinges 91 along its right-hand edge which are mirror images of the hinges 86 and therefore need not be described in detail.

FIG. 5 shows the opposite peripheral members (top and bottom or the opposite sides) for a double glass window having front and rear window panes 95 and 96 separated by a spacer 97 along their edges. This window pane and spacer sub-assembly is held in place by a snap-in glazing strip 98 along each edge of the sub-assembly. This glazing strip is a deformable and resilient plastic extrusion having a thin flat outer leg 99 which extends flush against the outer face of rear window pane 96, a slightly tapered inner leg 100 extending from leg 89 at an angle slightly less than 90 degrees and engaging the spacer 97 and the edge of front window pane 95, and a tapered lip 101 extending out from inner leg 100 and contiguously engaging the inclined edge 28W on one side of the first groove 26W in the adjacent peripheral member on the window. The glazing strip 98 is resiliently deformed by its snap-in engagement, as shown, so that it holds the front window pane 95 against the exposed faces 40W and 41W of the extension 11W of the adjacent peripheral member on the window.

Figure 6:
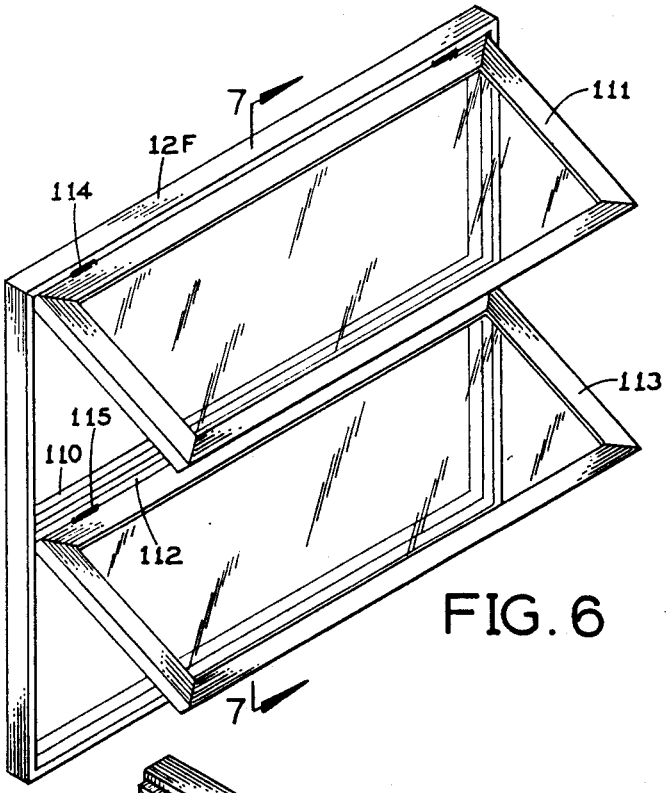
FIG. 6 is a perspective view of an awning window having the same peripheral members on both windows and on the framework as in the embodiment of the invention shown in FIGS. 1–4.

FIGS. 6 and 7 illustrate a third embodiment of the invention having upper and lower windows which are horizontally hinged at the top to the framework. This embodiment is basically similar to the first embodiment (FIGS. 1–4) except for the location of the hinges and the size and shape of the windows which in FIGS. 6 and 7 are longer horizontally and shorter vertically than in FIGS. 1–4.

In FIGS. 6 and 7, the lower peripheral member 110 in the framework for the upper window 111 is adhesively joined to the upper peripheral member 112 in the framework for the lower window 113, with the first sides 12F of these two peripheral members extending contiguous to each other across the full width of each window.

In FIGS. 6 and 7, the sealing gasket 65 is seated in the first groove 26F in each peripheral member in the framework, and the soft-bristled weatherstrip element 69 is seated in the second groove 36F in each peripheral member in the framework, as in the embodiment of FIGS. 1–4.

Each hinge 114 for upper window 111 and each hinge 115 for lower window 113 is arranged the same as described in detail for hinge 86 in the embodiment of FIGS. 1–4.

Figure 8:
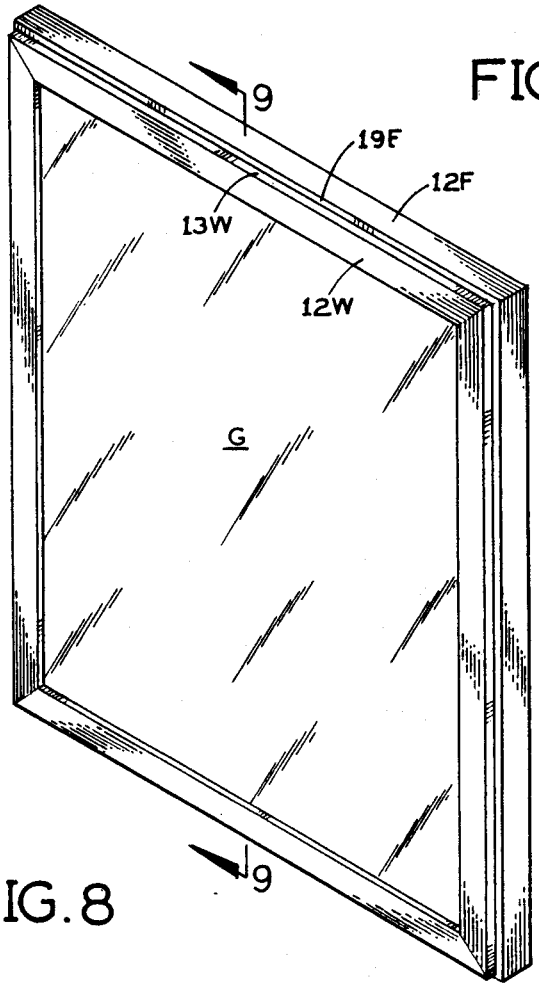
FIG. 8 is a perspective view of another embodiment of the invention having a window that is permanently closed.
Figure 9:
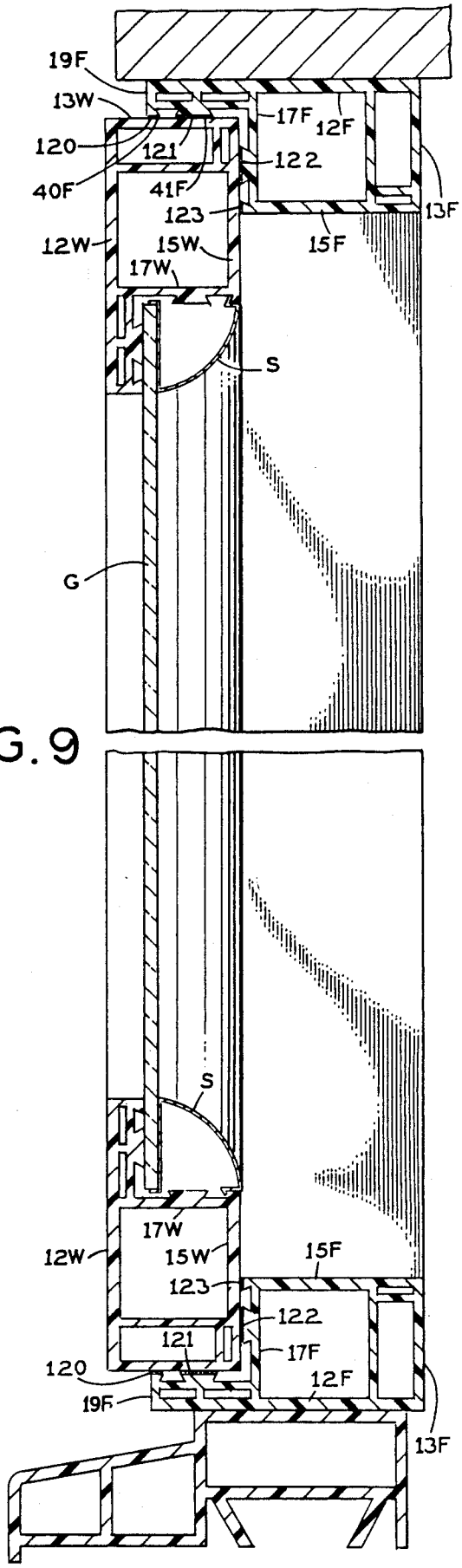
FIG. 9 is a vertical cross-section taken along the line 9—9 in FIG. 8.

FIGS. 8 and 9 show a fourth embodiment of the invention in a window assembly having a window that is fixed closed and cannot be opened. The peripheral members for the framework form a rectangle extending around and behind the peripheral members on the window. As shown in FIG. 9, the outer end 13W of each peripheral member on the window is adhesively secured at 120 and 121 to the faces 40F and 41F of the extension on the corresponding peripheral member in the framework, and the second side 15W of each peripheral member on the window is adhesively secured at 122 and 123 to the faces 31F and 30F of the main body of the corresponding peripheral member in the framework. (The sealing gasket 65 and the weatherstripping element 69, present in FIGS. 1–4, are omitted in the embodiment of FIGS. 8 and 9.)

In other respects, the peripheral members on the window and the peripheral members in the framework are arranged with respect to each other as described for Figures 1–4.

In one practical embodiment, the peripheral member shown in FIG. 2 has the following dimensions: width of the first side 12 between corners 14 and 20, 52.387 mm.; thickness on side 12, 2.286 mm.; width of outer end 13 between corners 14 and 16, 25.400 mm; thickness of end 13, 1.524 mm.; width of second side 15 between corners 16 and 18, 34.144 mm.; thickness of side 15 between outer end 13 and the first reinforcing wall 24, 1.524 mm.; thickness of side 15 between wall 24 and inner end 17, 2.286 mm.; thickness of inner end 17 at grooves 27 and 32, 1.524 mm.; thickness of inner end 17 at flats 30 and 31, 3.048 mm.; width of reinforcing wall 24 between first side 12 and second side 15, 20.83 mm.; thickness wall 24, 1.270 mm.; width of the second reinforcing wall 25 between outer end 13 and first reinforcing wall 24, 7.472 mm.; thickness of wall 25, 1.524 mm.; width of the second side 21 of extension 11 between the inside corner 23 and side edge 38 of groove 36, 16.362 mm.; thickness of side 21 at grooves 42 and 36, 1.524 mm.; thickness of side 21 at flats 41 and 40, 3.048 mm.; width of reinforcing segment 35 between first side 12 and second side 21 of extension 11, 1.829 mm.; thickness of segment 35, 1.524 mm.; width of outer end 19 of extension 11 between corners 20 and 22, 7.161 mm.; thickness of end 19 between first side 12 and second side 21 of extension 11, 1.524 mm. The material of this peripheral member is polyvinyl chloride.

From the foregoing description and the accompanying drawings it will be evident that the peripheral member of the present invention can be used in a wide variety of window installations to simplify and reduce the cost of such installations.

While the peripheral member of the present invention is specifically intended for use with like peripheral members to provide both a frame holding a window pane or panes and a framework mounted in a window opening in a building, it is to be understood that this peripheral member may be used with peripheral members of different cross-section in a frame holding a window pane or panes in a building-mounted framework.

I claim:

1. A peripheral member for attachment along an edge of a window and along the inside edge of an opening for a window in a building wall, said peripheral member comprising: an elongated main body of generally rectangular cross-section having a first side presenting an exposed flat face, an outer end presenting an exposed flat outer end face perpendicularly intersecting said exposed face of said first side at a first outside corner on said main body, a second side presenting an exposed flat face perpendicularly intersecting said outer end face at a second outside corner on said main body and extending from said outer end face parallel to said exposed face of said first side, said exposed flat outer end face of said outer end being continuous and uninterrupted between said first and second outside corners, and an inner end extending substantially parallel to said outer end perpendicularly between said first and second sides, said inner end forming a third outside corner with said exposed face of said second side, said inner end having a longitudinal first groove therein near said third outside corner;

and an elongated extension of generally rectangular cross-section joined to said main body at said inner end and projecting from said main body in the direction away from said outer end of the main body, said extension having a first side presenting an exposed flat face which is a coplanar continuation of said exposed face of said first side of the main body, an outer end presenting an exposed end face intersecting and extending transversely from said exposed face of said first side of the extension at a fourth outside corner spaced from side inner end of the main body, and a second side extending generally parallel to said first side of the extension from said outer end of the extension to said inner end of the main body, said second side of the extension forming a fifth outside corner with said end face of the extension and forming an inside corner with said inner end of the main body.

2. A peripheral member according to claim 1 wherein: said inner end of the main body has a longitudinal recess therein next to said inside corner.

3. A peripheral member according to claim 1 wherein: said second side of the extension has a longitudinal groove therein near said fifth outside corner.

4. A peripheral member for attachment along and edge of a window and along the inside edge of an opening for a window in a building wall, said peripheral member comprising: an elongated main body of generally rectangular cross-section having a first side presenting an exposed flat face, an outer end presenting an exposed flat outer end face perpendicularly intersecting said exposed face of said first side at a first outside corner on said main body, a second side presenting an exposed flat face perpendicularly intersecting said outer end face at a second outside corner on said main body and extending from said outer end face parallel to said exposed face of said first side, and an inner end extending substantially parallel to said outer end perpendicularly between said first and second sides, said inner end forming a third outside corner with said exposed face of said second side, said inner end having a longitudinal first groove therein near said third outside corner;

and an elongated extension of generally rectangular cross-section joined to said main body at said inner end and projecting from said main body in the direction away from said outer end of the main body, said extension having a first side presenting an exposed flat face which is a coplanar continuation of said exposed face of said first side of the main body, an outer end presenting an exposed end face intersecting and extending transversely from said exposed face of said first side of the extension at a fourth outside corner spaced from said inner end of the main body, and a second side extending generally parallel to said first side of the extension from said outer end of the extension to said inner end of the main body, said second side of the extension forming a fifth outside corner with said end face of the extension and forming an inside corner with said inner end of the main body, said second side of the extension having a longitudinal groove therein near said fifth outside corner; said second side of the extension having a longitudinal recess therein next to said inside corner.

5. A peripheral member for attachment along an edge of a window and along the inside edge of an opening for a window in a building wall, said peripheral member comprising: an elongated main body of generally rectangular cross-section having a first side presenting an exposed flat face, an outer end presenting an exposed flat outer end face perpendicularly intersecting said exposed face of said first side at a first outside corner on said main body, a second side presenting an exposed flat face perpendicularly intersecting said outer end face at a second outside corner on said main body and extending from said outer end face parallel to said exposed face of said first side, and an inner end extending substantially parallel to said outer end perpendicularly between said first and second sides, said inner end forming a third outside corner with said exposed face of said second side, said inner end having a longitudinal first groove therein near said third outside corner;

and an elongated extension of generally rectangular cross-section joined to said main body at said inner end and projecting from said main body in the direction away from said outer end of the main body, said extension having a first side presenting an exposed flat face which is a coplanar continuation of said exposed face of said first side of the main body, an outer end presenting an exposed end face intersecting and extending transversely from said exposed face of said first side of the extension at a fourth outside corner spaced from said inner end of the main body, and a second side extending generally parallel to said first side of the extension from said outer end of the extension to said inner end of the main body, said second side of the extension forming a fifth outside corner with said end face of the extension and forming an inside corner with said inner end of the main body, said second side of said extension having a longitudinal recess therein next to said inside corner.

6. A peripheral member for attachment along an edge of a window and along the inside edge of an opening for a window in a building wall, said peripheral member comprising: an elongated main body of generally rectangular cross-section having a first side presenting an exposed flat face, an outer end presenting an exposed flat outer end face perpendicularly intersecting said exposed face of said first side at a first outside corner on said main body, a second side presenting an exposed flat face perpendicularly intersecting said outer end face at a second outside corner on said main body and extending from said outer end face parallel to said exposed face of said first side, and an inner end extending substantially parallel to said outer end perpendicularly between said first and second sides, said inner end forming a third outside corner with said exposed face of said second side, said inner end having a longitudinal first groove therein near said third outside corner, said inner end of the main body having a longitudinal recess therein next to said inside corner;

and an elongated extension of generally rectangular cross-section joined to said main body at said inner end and projecting from said main body in the direction away from said outer end of the main body, said extension having a first side presenting an exposed flat face which is a coplanar continuation of said exposed face of said first side of the main body, an outer end presenting an exposed end face intersecting and extending transversely from said exposed face of said first side of the extension at a fourth outside corner spaced from said inner end of the main body, and a second side extending generally parallel to said first side of the extension from said outer end of the extension to said inner end of the main body, said second side of the extension forming a fifth outside corner with said end face of the extension and forming an inside corner with said inner end of the main body, said second side of said extension having a longitudinal recess therein next to said inside corner which intersects said longitudinal recess in said inner end of the main body.

7. A peripheral member according to claim 6 wherein: said second side of the extension has a longitudinal groove therein near said fifth outside corner.

8. A window comprising:

a flat rectangular window pane;

a plurality of elongated peripheral members extending respectively along the edges of said window pane, each of said peripheral members having:

an elongated main body of generally rectangular cross-section with a first side presenting an exposed flat face, an outer end presenting an exposed flat outer end face perpendicularly intersecting said exposed face of said first side at a first outside corner on said main body, a second side presenting an exposed flat face perpendicularly intersecting said outer end face at a second outside corner on said main body and extending from said outer end face parallel to said exposed face of said first side, said exposed flat outer end face of said outer end being continuous and uninterrupted between said first and second outside corners, and an inner end extending substantially parallel to said outer end perpendicularly between said first and second sides and in close proximity to an adjacent edge of the window pane, said inner end forming a third outside corner with said exposed face of said second side;

said inner end having a longitudinal groove therein near said third outside corner and spaced behind the rear face of the window pane, and said inner end having a longitudinal recess therein next to said inside corner and extending across the adjacent edge of the window pane;

and an elongated extension of generally rectangular cross-section joined to said main body at said inner end and projecting from said main body across the front face of the window pane, said extension having a first side presenting an exposed flat face which is a coplanar continuation of said exposed face of said first side of the main body, an outer end presenting an exposed end face intersecting and extending transversely from said exposed face of said first side of the extension at a fourth outside corner spaced from said inner end of the main body, and a second side extending next to the front face of the window pane generally parallel to said first side of the extension from said outer end of the extension to said inner end of the main body, said second side of the extension forming a fifth outside corner with said end face of the extension and forming an inside corner with said inner end of the main body;

and a flexible and resilient glazing strip having a snap-in engagement between said peripheral member and the window pane, said glazing strip having a transverse flange on one end seated in said groove in said inner end of said main body of the peripheral member, an arcuate leg extending from said flange toward the rear face of the window pane, a front leg extending from said arcuate leg across the rear face of the window pane and toward said inner end of said main body of the peripheral member, and a flange extending forward from said front leg into said recess in said inner end of said main body of the peripheral member and engaging the adjacent edge of the window pane, said glazing strip holding said window pane against said second side of the extension on the peripheral member.

9. A window comprising:

front and rear flat rectangular window panes in closely spaced parallel relationship;

a plurality of elongated peripheral members respectively extending along the edges of said window panes, each of said peripheral members having:

an elongated main body of generally rectangular cross-section with a first side presenting an exposed flat face, an outer end presenting an exposed flat outer end face perpendicularly intersecting said exposed face of said first side at a first outside corner on said main body, a second side presenting an exposed flat face perpendicularly intersecting said outer end face at a second outside corner on said main body and extending from said outer end face parallel to said exposed face of said first side, said exposed flat outer end face of said outer end being continuous and uninterrupted between said first and second outside corners, and an inner end extending substantially parallel to said outer end perpendicularly between said first and second sides and in close proximity to an adjacent edge of each of said front and rear window panes, said inner end forming a third outside corner with said exposed face of said second side, said inner end having a longitudinal groove therein near said third outside corner and substantially aligned with said rear window pane, said inner end being spaced from the adjacent edges of said window panes;

and an elongated extension of generally rectangular cross-section joined to said main body at said inner end and projecting from said main body across the front face of the front window pane, said extension having a first side presenting an exposed flat face which is a coplanar continuation of said exposed face of said first side of the main body, an outer end presenting an exposed end face intersecting and extending transversely from said exposed face of said first side of the extension at a fourth outside corner spaced from said inner end of the main body, and a second side extending next to said front face of the front window pane generally parallel to said first side of the extension from said outer end of the extension to said inner end of the main body, said second side of the extension forming a fifth outside corner with said end face of the extension and forming an inside corner with said inner end of the main body;

and a plurality of flexible and resilient glazing strips, each having a snap-in engagement between a corresponding peripheral member and said window panes, each said glazing strip having a rear segment engaging the back face of the rear window pane, a lip snugly received in said groove in said inner end of said main body of the peripheral member, and a forwardly projecting segment extending into engagement with the adjacent edge of the front window pane.

10. A framework for attachment along the edges of an opening for a window in a building, said framework comprising:

a rectangular assembly of elongated peripheral of said first side of the main body, an outer end presenting an exposed end face intersecting and extending transversely from said exposed face of said first side of the extension at a fourth outside corner spaced from said inner end of the main body, and a second side extending generally parallel to said first side of the extension from said outer end of the extension to said inner end of the main body, said second side of the extension forming a fifth outside corner with said end face of the extension and forming an inside corner with said inner end of the main body;

said first sides of said main body and said extension being attachable to a corresponding edge of the window opening in building;

and a plurality of sealing gaskets respectively seated in said first grooves and projecting past said inner ends of the main bodies of the peripheral members.

11. A peripheral structure according to claim 10 wherein:

said second side of said extension has a longitudinal second groove therein near said fifth outside corner; and further comprising:

a weatherstrip member seated in said second groove and projecting past said second side of said extension.

12. A peripheral structure according to claim 11 wherein:

said second side of said extension has a longitudinal recess therein next to said inside corner.

13. A peripheral structure according to claim 10 wherein:

said second side of said extension has a longitudinal recess therein next to said inside corner.

14. The combination of a window comprising;

a flat rectangular window pane;

a plurality of elongated peripheral members extending respectively along the edges of said window pane, each of said peripheral members having:

an elongated main body of generally rectangular cross-section with a first side presenting an exposed flat face, an outer end presenting an exposed flat outer end face perpendicularly intersecting said exposed face of said firt side at a first outside corner on said main body, a second side presenting an exposed flat face perpendicularly intersecting said outer end face at a second outside corner on said main body and extending from said outer end face parallel to said exposed face of said first side, and an inner end extending substantially parallel to said outer end perpendicularly between said first and second sides and in close proximity to an adjacent edge of the window pane, said inner end forming a third outside corner with said exposed face of said second side;

said inner end having a longitudinal groove therein near said third outside corner and spaced behind the rear face of the window pane, and said inner end having a longitudinal recess therein next to said inside corner and extending across the adjacent edge of the window and an elongated extension of generally rectangular cross-section joined to said main body at said inner end and projecting from said main body across the front face of the window pane, said extension having a first side presenting an exposed flat face which is a coplanar continuation of said exposed face of said first side of the main body, an outer end presenting an exposed end face intersecting and extending transversely from said exposed face of said first side of the extension at a fourth outside corner spaced from said inner end of the main body, and a second side extending next to the front face of the window pane generally parallel to said first side of the extension from said outer end of the extension to said inner end of the main body, said second side of the extension forming a fifth outside corner with said end face of the extension and forming an inside corner with said inner end of the main body;

and a flexible and resilient glazing strip having a snap-in engagement between said peripheral member and the window pane, said glazing strip having a transverse flange on one end seated in said groove in said inner end of said main body of the peripheral member, an arcuate leg extending from said flange toward the rear face of the window pane, a front leg extending from said arcuate leg across the rear face of the window pane and toward said inner end of said main body of the peripheral member, and a flange extending forward from said front leg into said recess in said inner end of said main body of the peripheral member and engaging the adjacent edge of the window pane, said glazing strip holding said window pane against said second side of the extension on the peripheral member; and a framework for attachment along the edge of an opening for the window in a building, said framework comprising:

a rectangular assembly of elongated peripheral members each adapted to extend along a corresponding edge of the opening and each having: an elongated main body of generally rectangular cross-section with a first side presenting an exposed flat face, an outer end presenting an exposed flat outer end face perpendicularly intersecting said exposed face of said first side at a first outside corner on said main body, a second side presenting an exposed flat face perpendicularly intersecting said outer end face at a second end corner on said main body and extending from said outer end face parallel to said exposed face of said first side, and an inner end extending substantially parallel to said outer end perpendicularly between said first and second sides, said inner end forming a third outside corner with said exposed face of said second side;

and an elongated extension of generally rectangular cross-section joined to said main body at said inner end and projecting from said main body in the direction away from said outer end of the main body, said extension having a first side presenting an exposed flat face which is a coplanar continuation of said exposed face of said first side of the main body, an outer end presenting an exposed end face intersecting and extending transversely from said exposed face of said first side of the extension at a fourth outside corner spaced from said inner end of the main body, and a second side extending generally parallel to said first side of the extension from said outer end of the extension to said inner end of the main body, said second side of the extension forming a fifth outside corner with said end face of the extension and forming an inside corner with said inner end of the main body;

each of said peripheral members of said framework having its said inner end extending from said second outside corner of an adjacent peripheral member on the window part-way across said second side of said adjacent peripheral member on the window;

and each of said peripheral members of said framework having said second side of its extension extending from said second outside corner of said adjacent peripheral member on the window part-way across said outer end of said adjacent peripheral member on the window.

15. The combination of claim 14 wherein:

said inner end of said main body of each of said peripheral members in the framework has a longitudinal first groove therein near said third outside corner; and further comprising:

a plurality of sealing gaskets respectively seated in said first grooves in said peripheral members of the framework and each engaging said second side of said main body of the adjacent peripheral member on the window.

16. The combination of claim 15 and further comprising:

hinge means pivotally connecting one of said peripheral members on the window to the adjacent peripheral member of said framework, said hinge means having its hinge axis close to said fifth outside corner on said adjacent peripheral member of the framework.

17. The combination of claim 16 wherein:

said second side of said extension on each of said peripheral members in the framework has a longitudinal second groove therein near said fifth outside corner; and further comprising:

weatherstrip members seated in said second grooves in said peripheral members in the framework except the peripheral member in the framework where said hinge means is located, each of said weathstrip members engaging said outer end of said main body of the adjacent peripheral member on the window.

18. The combination of claim 14 wherein:

said inner end of said main body of each of said peripheral members in the framework is adhesively secured to said second side of said main body of the adjacent peripheral member of the window;

and said second side of said extension on each of said peripheral members in the framework is adhesively secured to said outer end of said main body of the adjacent peripheral member of the window.

19. A peripheral member for attachment along an edge of a window and along the inside edge of an opening for a window in a building wall, said peripheral member comprising:

an elongated hollow main body of rectangular cross-section and an elongated extension of rectangular cross-section joined to said main body, said main body and said extension having co-planar flat faces on one side, said extension being substantially narrower than said main body perpendicular to said co-planar faces, said main body and said extension having mutually perpendicular sides which intersect to form an inside corner on the opposite side of the peripheral member from said co-planner faces, said mutually perpendicular sides of said main body and said extension having respective longitudinal recesses therein which intersect at said corner and respective longitudinal grooves therein located away from said corner, the remaining sides of said main body and said extension being flat.

* * * * *